United States Patent [19]

Ackerman

[11] 4,378,183

[45] Mar. 29, 1983

[54] APPARATUS AND METHOD FOR PUMPING HOT, EROSIVE SLURRY OF COAL SOLIDS IN COAL DERIVED, WATER IMMISCIBLE LIQUID

[75] Inventor: Carl D. Ackerman, Olympia, Wash.

[73] Assignee: The Pittsburgh & Midway Coal Mining Co., Englewood, Colo.

[21] Appl. No.: 188,506

[22] Filed: Sep. 18, 1980

[51] Int. Cl.[3] ..... B65G 53/30

[52] U.S. Cl. ..... 406/109; 406/96; 417/55; 417/92; 417/900

[58] Field of Search ..... 417/92, 98, 383, 384, 417/385-388, 900, 53-55; 406/96, 109

[56] References Cited

U.S. PATENT DOCUMENTS

| | | | |
|---|---|---|---|
| 404,030 | 5/1889 | Conklin | 137/564.5 |
| 1,697,682 | 1/1929 | Ferraris | 417/439 |
| 2,644,401 | 7/1953 | Ragland | 417/900 X |
| 2,902,936 | 9/1959 | Bradley | 417/387 |
| 3,080,820 | 3/1963 | Browne | 417/347 |
| 3,241,496 | 3/1966 | Imai et al. | 417/98 |
| 3,318,251 | 5/1967 | Smith | 417/385 X |
| 3,740,166 | 6/1973 | Seki et al. | 417/900 X |
| 3,749,522 | 7/1973 | Kazama et al. | 417/900 X |
| 3,891,352 | 6/1975 | Tsukamoto | 417/900 X |
| 3,938,912 | 2/1976 | Sakamoto et al. | 417/900 X |
| 4,239,423 | 12/1980 | Sakamoto et al. | 406/47 |

*Primary Examiner*—Edward K. Look

*Attorney, Agent, or Firm*—Deane E. Keith; Forrest D. Stine; Alvin E. Ring

[57] ABSTRACT

An apparatus for and method of pumping hot, erosive slurry of coal solids in a coal derived, water immiscible liquid to higher pressure involves the use of a motive fluid which is miscible with the liquid of the slurry. The apparatus includes a pump 12, a remote check valve 14 and a chamber 16 between and in fluid communication with the pump 12 and check valve 14 through conduits 18,20. Pump 12 exerts pressure on the motive fluid and thereby on the slurry through a concentration gradient of coal solids within chamber 16 to alternately discharge slurry under pressure from the outlet port of check valve 14 and draw slurry in through the inlet port of check valve 14.

34 Claims, 1 Drawing Figure

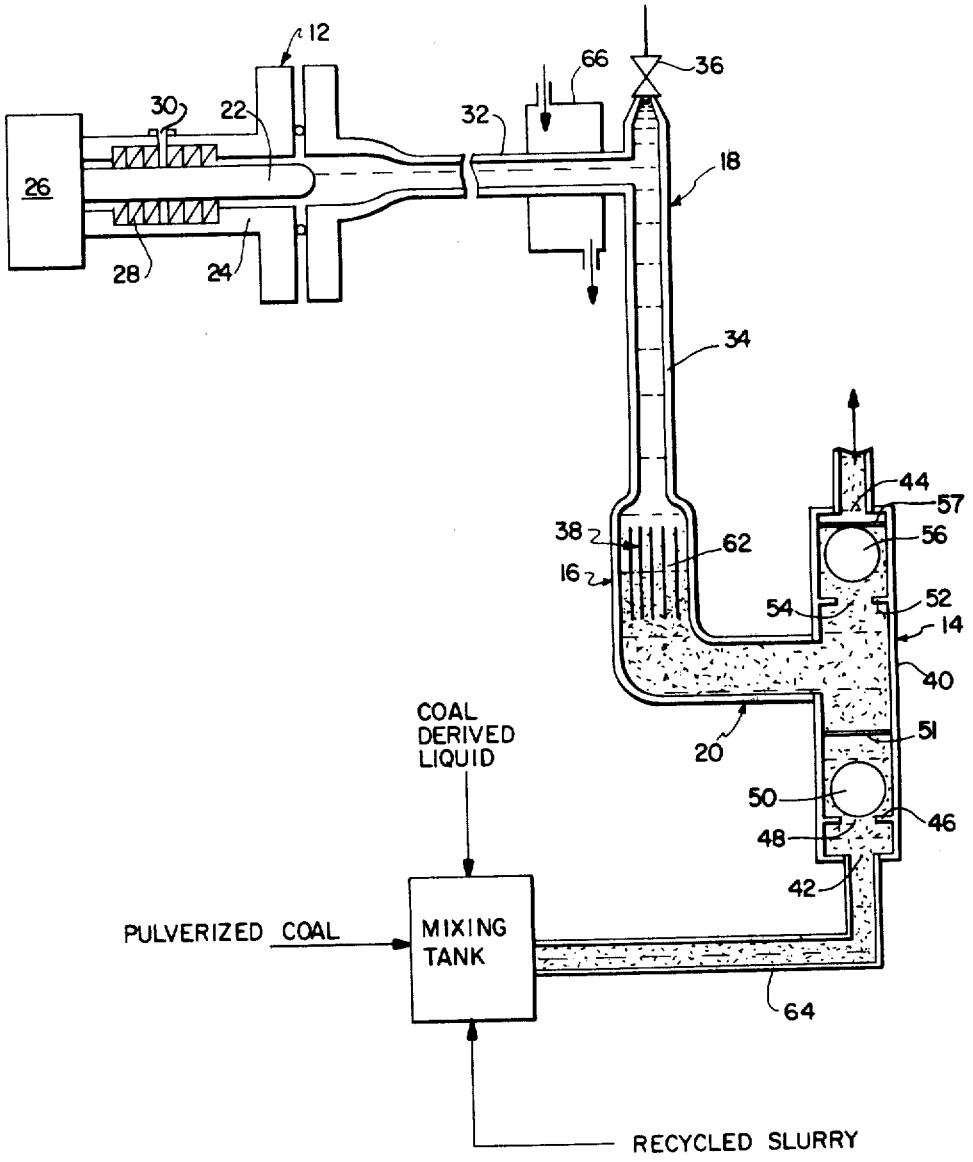
12
66
36
30
22
32
18
26
28
24
34
44
57
38
62
56
16
54
52
14
40
COAL
DERIVED
LIQUID
20
51
50
46
48
42
PULVERIZED COAL
MIXING
TANK
64
RECYCLED SLURRY

APPARATUS AND METHOD FOR PUMPING HOT, EROSIVE SLURRY OF COAL SOLIDS IN COAL DERIVED, WATER IMMISCIBLE LIQUID

The Government of the United States of America has rights in this invention pursuant to Contracts Nos. DE-AC01-79ET10104 and DE-AC05-78OR03055 awarded by the U.S. Department of Energy to The Pittsburg & Midway Coal Mining Co., a subsidiary of Gulf Oil Corporation.

BACKGROUND OF THE INVENTION

1. Field of the Invention

This invention relates to an apparatus and a method for pumping a hot, erosive slurry of coal solids in a coal derived, water immiscible liquid. More particularly, the present invention relates to the use of a motive fluid which is miscible with the coal derived liquid of the slurry to produce a concentration gradient of coal solids through which the reciprocating action of a pump is transmitted.

2. Description of the Prior Art

In coal liquefaction processes, hot erosive slurries of coal solids in a coal derived, water immiscible liquid must be pumped. The temperature and erosive nature of the slurry is detrimental to the pumping apparatus by causing rapid wear and damage to the pump mechanism. Rapid wear and damage to the pump necessitate interruptions to the process and result in high maintenance costs.

Conventional apparatus and methods of pumping erosive slurries, such as ore slurries or sludgy water, have used a liquid medium which is immiscible with the slurry liquid and is acted upon by a reciprocating piston to pump the slurry. For example, U.S. Pat. No. 3,241,496 to Imani et al discloses a system for pumping erosive slurries which comprises a pumping apparatus with a remote check valve arrangement and an expanded chamber between the pump and check valve to prevent the abrasive particles in the slurry from entering the pump mechanism. The Imani et al apparatus employs a liquid medium which has a lower specific gravity than that of the slurry and is of such a nature that it does not mix with, dissolve into or react with the slurry to be pumped. A boundary layer is formed between the immiscible liquid medium and the slurry. A stabilizing arrangement is used in combination with the boundary layer formation in the chamber to prevent horizonal movement of the layer and, thus, inhibit intermixing of the slurry and the liquid medium.

The Imani et al system cannot be utilized to pump a hot, erosive slurry of coal solids and a coal derived, water immiscible liquid for use in a coal liquefaction process, since a liquid that is immiscible with the oily slurry liquid such as an aqueous medium, e.g., water, can have an adverse effect upon the system. Thus, it would not be possible to prevent mixing of the water and the coal slurry, and the water would become emulsified in the slurry liquid. The emulsification of the water and slurry liquid would cause erratic pump performance and excessive wear and damage to the pump mechanism due to the corrosive and non-lubricant nature of the aqueous fluid. Additionally, liquids such as water boil upon contact with the hot slurry which is normally at a temperature in the range of 250° to 700° F. (121° to 371° C.) thereby causing pump cavitation and foaming.

SUMMARY OF THE INVENTION

It has now been discovered that the disadvantages associated with the use of conventional slurry pumping systems for pumping a slurry of coal solids in a coal derived, water immiscible liquid are eliminated by employing a motive fluid which is miscible with the liquid of the slurry. The miscible motive fluid acts on the slurry through a concentration gradient of coal solids to minimize migration of coal solids toward the pump, thereby permitting the pump to be substantially isolated from the abrasive coal solids without using a motive liquid that would adversely affect the coal liquefaction process or pumping mechanism. The expression "coal solids", as used in this application, includes the solid materials normally suspended in the slurry of a coal liquefaction process, namely, feed coal, unreacted coal, coal minerals (ash) as well as solid catalyst particles used in coal liquefaction processes.

The present invention comprises an apparatus for pumping a hot, erosive slurry of coal solids in a coal derived, water immiscible liquid to higher pressure, and comprises pumping means and remote check valve means having inlet and outlet ports for controlling suction and discharge of slurry flow. A connecting chamber is provided in fluid communication with the pumping means through a first conduit and with the check valve means through a second conduit. The second conduit and the check valve means contain hot, erosive slurry of coal solids in a coal derived, water immiscible liquid to be pumped. The pumping means and the first conduit contain a motive fluid which is a coal derived liquid that is miscible with the liquid of the slurry. A concentration gradient of coal solids is formed in the chamber having an increasingly greater density of the coal solids in the downstream direction, i.e., away from the pumping means and towards the check valve means.

The invention also comprises a method of pumping a hot, erosive slurry comprising coal solids in a coal derived, water immiscible liquid from a first pressure to a second higher pressure. The hot, erosive slurry is passed through an inlet of a check valve zone at the first pressure and into one end of a chamber zone. A motive fluid exerts pressure on the slurry through a concentration gradient of coal solids in the chamber zone to close the inlet of the check valve zone, to open an outlet of the check valve zone and to discharge slurry from the outlet under the second, higher pressure. The concentration gradient of coal solids has a gradually increasing density of coal solids in a downstream direction, i.e., away from the motive fluid and towards the check valve zone. The motive fluid is miscible with the coal derived, water immiscible liquid. The pressure exerted on the slurry by the motive fluid is reduced below the first pressure to close the outlet of the check valve zone, to open the inlet of the check valve zone and to suction additional slurry into the check valve zone through the inlet.

By forming the apparatus and by performing the method of the present invention in this manner, the motive fluid operates through a concentration gradient rather than a boundary layer. Since the motive fluid is miscible in the liquid of the slurry, any motive fluid mixed with the slurry will not adversely affect the coal liquefaction process, or the pumping mechanism. Such motive fluid will not cause erratic pump performance, excessive wear and damage due to the non-corrosive and lubricant nature of the miscible fluid. Moreover, a miscible motive fluid which is predominantly aromatic is preferred because it will further improve operation by dissolving or preventing sticky deposits in the conduits. Preferred pump slurry temperatures for coal liquefaction processes, e.g., 250° to 700° F. (121° to 371° C.), will not cause the miscible fluids to boil, thereby avoiding pump cavitation and foaming.

Other advantages and salient features of the present invention will become apparent from the following detailed description, which taken in conjunction with the annexed drawing, discloses a preferred embodiment of the present invention.

BRIEF DESCRIPTION OF THE DRAWING

The single FIGURE is a schematic illustration of an apparatus for pumping hot, erosive slurry of coal solids in a coal derived, water immiscible liquid in accordance with the present invention.

DETAILED DESCRIPTION OF THE PREFERRED EMBODIMENT OF THE INVENTION

Referring to the FIGURE, the apparatus for pumping a hot, erosive slurry of coal solids in a coal derived, water immiscible liquid from a lower to a higher pressure comprises a pumping mechanism 12, a remote check valve mechanism 14 and an expanded chamber 16 therebetween. Chamber 16 is in fluid communication with pumping mechanism 12 through a first conduit 18. Chamber 16 is in fluid communication with check valve mechanism 14 through the second conduit 20.

The pumping mechanism 12 is of the reciprocating, piston-cylinder type. Piston 22 is caused to reciprocate within cylinder 24 by a suitable and conventional driving mechanism 26. Cylinder 24 has suitable packing 28 to provide an adequate seal between piston 22 and cylinder 24. An inlet 30 is provided in the cylinder 24 at packing 28 to inject clean motive fluid into the apparatus as necessary.

First conduit 18 may comprise a generally horizontal section 32 and a generally vertical section 34. The horizontal section 32 may slope upwardly in a direction away from pump mechanism 12 at a rate of ½ inch per foot to aid at startup in venting gas and liquid filling and is of indefinite length depending on installation requirements.

A venting and/or sampling valve 36 is provided adjacent the juncture of first conduit sections 32, 34. This valve may be used to withdraw a sample of the fluid in first conduit 18 to check for contamination, and may be used to relieve pressure within first conduit 18. Additionally, valve 36 may be employed to vent gas during startup. If the amount of coal solids in first conduit 18 becomes too high, a large excess of motive fluid may be added in inlet 30 to flush out the coal solids from conduit section 32 to prevent the coal solids from damaging pump mechanism 12. Excess motive fluid is taken off through valve 36 and passed through a separation means to separate the coal solids from the motive fluid. The purified motive fluid may be recycled to inlet 30 for reuse.

Chamber 16 is generally cylindrical in shape and of greater cross-sectional area than first conduit 18. The greater cross-sectional area of chamber 16 reduces the amount of vertical movement necessary within such chamber. Preferably, chamber 16 is vertically and axially aligned with respect to the first conduit 18. A flow stabilizing arrangement 38 comprising a plurality of tubes, plates, fins, baffles or other suitable means is mounted within chamber 16 to reduce the Reynolds number of the flow within the chamber 16 to less than 2000 and less than the Reynolds number of the fluid flowing through conduits 18, 20. This streamlines the flow and minimizes mixing of the fluids in first conduit 18 and second conduit 20. The minimization of the turbulence by flow stabilizing arrangement 38 minimizes the migration of the coal solids in the slurry into the clean fluid in the first conduit 18. The volume included in the zone which encloses flow stabilizing arrangement 38 is at least as great as the maximum displacement of the pumping mechanism 12, and is preferably 2–10 times such displacement.

The second conduit 20 opens at one end thereof into the lower portion of chamber 16 and is substantially shorter than first conduit 18. The opposite end of the second conduit 20 opens into the middle of check valve mechanism 14. Normally, conduit 20 has a greater diameter than conduit 18, but a smaller diameter than chamber 16.

Check valve mechanism 14 comprises a hollow body 40 having a relatively low pressure slurry inlet port 42 at its lower end and a relatively high pressure slurry outlet port 44 at its upper end. A lower partition 46 is provided adjacent and above inlet 42 and has an opening 48 in the center thereof. A ball 50 is movable within body 40 above lower partition 46 and is shaped to mate with partition 46 to close opening 48. In a similar manner, an upper partition 52 with a central opening 54 is provided adjacent and below outlet port 44. A ball 56 is movable within body 40 above upper partition 52 and is shaped to mate with and close opening 54 in one position of the ball 56. Ball 50 is restrained from closing opening 54 by plate or baffle 51 located between partitions 46, 52. A plate or baffle 57 located between partition 52 and opening 44 prevents ball 56 from closing opening 44. Plates 51, 57 restrain movement of balls 50, 56 without substantially impairing slurry flow through check valve 14.

Check valve 14 and second conduit 20 are filled with a hot, erosive slurry of coal solids in a coal derived, water immiscible liquid to be pumped to a coal liquefaction process. Pump mechanism 12 and first conduit 18 are filled with a hydrocarbonaceous motive fluid, such as a coal derived, water immiscible liquid, which is miscible with the liquid of the slurry. The motive fluid preferably comprises a solvent boiling range liquid, e.g., boiling in the range between about 175° and about 455° C., and preferably between about 250° and about 455° C. A liquid having this boiling range will not significantly vaporize when intermixed with the hot slurry being pumped. This is an important advantage because vaporization of the motive fluid would induce erratic behavior of the pump and a loss of pump efficiency due to the requirement for compressing gases on each cycle. Thus, any motive fluid which will not significantly vaporize when intermixed with the hot slurry being pumped can be used in the present process. Additionally, the motive fluid is preferably a coal solvent liquid which is predominantly aromatic in nature. The aromatic nature of the motive fluid improves the operation of the system by dissolving or preventing sticky deposits in the system.

A concentration gradient or diffusion zone 62 of coal solids is formed in the chamber 16 at flow stabilizing arrangement 38. Concentration gradient 62 has a gradually increasing concentration of the coal solids in the downstream direction of pumping mechanism 12 (i.e., that direction away from pumping mechanism 12 and toward check valve mechanism 14).

The first conduit 18 may be insulated to prevent heat loss. The horizontal section 32 of conduit 18 may be cooled (e.g., by an indirect heat exchanger or other cooling apparatus 66) to prevent excessive temperatures in the pump mechanism 12. Chamber 16, second conduit 20 and check valve mechanism 14 may be suitably insulated and heated, e.g., by a high pressure steam trace, to maintain the slurry at the appropriate temperature and viscosity. Suitable temperature indicators may also be provided.

For a coal liquefaction process, pulverized coal and a coal derived, water immiscible recycle distillate liquid are added and mixed with recycled slurry in a mixing tank to form a hot, erosive slurry of coal solids and liquid. This slurry is conveyed through conduit 64 to the inlet port 42 of the check valve mechanism 14 at a first pressure.

In operation, miscible motive fluid is continuously added at the piston end of pump 12 at inlet 30 in relatively small amounts, e.g., 1-10 percent of the slurry flow. Periodically motive fluid may be added in larger amounts to purge the apparatus as necessary. Hot, erosive coal slurry to be pumped is fed through inlet port 42 into check valve mechanism 14 and some emerges into second conduit 20.

The slurry is discharged from the outlet port 44 under pressure by reciprocating piston 22 within cylinder 24. When piston 22 is pushed to the right, as illustrated in FIG. 1, by driving mechanism 26, a positive pressure, greater than the inlet pressure of the slurry, is exerted on the motive fluid which acts on the slurry through the concentration gradient 62 formed between the slurry and the motive fluid. This pressure on the slurry forces lower ball 50 against lower partition 46, thereby closing opening 48 to prevent backflow through inlet port 42. Such pressure on the slurry moves upper ball 56 away from upper partition 52, thereby permitting the flow of slurry through opening 54 and outlet port 44 under a second, higher pressure.

On the return stroke, piston 22 is moved to the left, as viewed in FIG. 1, by the driving mechanism 26 to create a reduced or suction pressure in the motive fluid. This reduced or suction pressure acts through the concentration gradient 62 to create a reduced or suction pressure on the slurry. The reduced or suction pressure on the slurry causes upper ball 56 to engage partition 52 and close opening 54 preventing backflow of fluid through outlet port 44. This reduced or suction pressure on the slurry also moves lower ball 50 away from lower partition 46 to permit additional slurry to be drawn through inlet port 42 and opening 48 to flow into check valve mechanism 14 and second conduit 20. Once the return stroke has been completed, the power or discharge stroke is repeated as discussed above.

By employing a motive fluid which is miscible with the liquid of the slurry, a slurry of coal solids and a coal derived, water immiscible liquid may be pumped to a higher pressure for a coal liquefaction process since the miscible motive fluid may become entrained in the slurry flow without adversely affecting the downstream coal liquefaction process. For example, if an immiscible motive fluid were employed, i.e., an aqueous motive fluid, it would tend to become emulsified in the flowing slurry and would become vaporized under process conditions to form water vapor. This water vapor would reduce the hydrogen potential pressure in the system and would necessitate increased hydrogen compression costs to compensate for the hydrogen partial pressure loss in the system. Also, by isolating the hot, erosive slurry from pumping mechanism 12 with the motive fluid, the temperature and erosive nature of the slurry will not damage the moving parts of the pumping mechanism 12.

By providing the motive fluid inlet 30 in packing 28 of pumping mechanism 12, a motive fluid flow is created in the apparatus away from pumping mechanism 12 as well as replacing motive fluid lost in the slurry. An additional motive fluid inlet may be provided if insufficient motive fluid passes through packing 28. This flow further prevents the hot, erosive slurry from contacting and damaging pumping mechanism 12. The motive fluid may also be added in sections 32, 34 of conduit 18 as long as it is added upstream of the concentration gradient 62 (i.e., in the pure portion of the motive fluid) although section 34 is less preferred. The addition of motive fluid is preferably a limited flow at a fixed pressure, although it may also be from a supply of constant pressure or a fixed flow at variable pressure. The preferred fixed pressure is less than the outlet or second pressure, but greater than the inlet or first pressure of the slurry.

The total volume of fluid in conduits 18, 20 and chamber 16 should be substantially greater than the displacement of pumping mechanism 12, such as 1-10 times greater. Such volume should be limited based on the loss in pump efficiency, which is proportional to the total volume times the compressibility of the fluids.

Although the invention has been described in considerable detail with particular reference to a certain preferred embodiment thereof, variations and modifications can be effected within the spirit and scope of the invention as defined in the appended claims.

What is claimed is:

1. An apparatus for pumping a hot, erosive slurry of coal solids in a coal derived, water immiscible liquid to higher pressure which comprises:

pumping means;

remote check valve means separated from said pumping means having inlet and outlet ports for controlling suction and discharge of slurry;

a chamber in fluid communication with said pumping means through a first conduit and with said check valve means through a second conduit, said second conduit and said check valve means containing hot, erosive slurry of coal solids in a coal derived, water immiscible liquid; and said pumping means and said first conduit containing a motive fluid which is miscible with the liquid of said slurry such that said motive fluid directly contacts said pumping means and intermixes with said slurry, whereby a concentration gradient of coal solids is formed in said chamber having an increasing greater concentration of said coal solids in a direction downstream of said pumping means.

2. The apparatus of claim 1, wherein said motive fluid is a carbonaceous material.

3. The apparatus of claim 1, wherein said motive fluid is a coal derived liquid.

4. The apparatus of claim 3, wherein said motive fluid is coal solvent liquid.

5. The apparatus of claim 4, wherein said motive fluid is predominantly aromatic in nature.

6. The apparatus of claim 3, wherein said motive fluid boils in the range of 175° to 455° C.

7. The apparatus of claim 6, wherein said motive fluid boils in the range of 250° to 455° C.

8. The apparatus of claim 1, wherein said motive fluid does not significantly vaporize when intermixed with said slurry.

9. The apparatus of claim 1, wherein said chamber has a greater cross-sectional area than said first conduit.

10. The apparatus of claim 1, wherein said chamber has flow stabilizing means therein to substantially prevent movement of said concentration gradient perpendicular to the flow through said chamber.

11. The apparatus of claim 1, wherein said pumping means comprises a piston and cylinder.

12. The apparatus of claim 1, wherein motive fluid inlet means is provided in said pumping means.

13. The apparatus of claim 1, wherein said first conduit has cooling means between said chamber and said pumping means.

14. The apparatus of claim 13, wherein said cooling means is an indirect heat exchanger.

15. A method for pumping a hot erosive slurry comprising coal solids in a coal derived, water immiscible liquid from a first pressure to a second, higher pressure, which comprises:

passing said slurry through an inlet of a check valve zone at said first pressure and into one end of a chamber zone;

exerting pressure on said slurry with a motive fluid, which is pressurized by direct contact with a pump and intermixes with said slurry, through a concentration gradient of coal solids in said chamber zone to close said inlet of said check valve zone, to open an outlet of said check valve zone and to discharge slurry from said outlet under said second, higher pressure, said concentration gradient of coal solids having a gradually increasing concentration of coal solids in a downstream direction, said motive fluid being miscible with said coal derived, water immiscible liquid; and reducing the pressure exerted on said slurry by said motive fluid below said first pressure to close said outlet of said check valve zone, to open said inlet of said check valve zone and to draw additional slurry into said check valve zone through said inlet.

16. The method of claim 15, wherein said motive fluid is a carbonaceous material.

17. The method of claim 15, wherein said motive fluid is in a coal derived liquid.

18. The method of claim 17, wherein said motive fluid is a coal solvent liquid.

19. The method of claim 18, wherein said motive fluid is predominantly aromatic in nature.

20. The method of claim 17, wherein said motive motive fluid boils in the range of 175° to 455° C.

21. The method of claim 20, wherein said motive fluid boils in the range of 250° to 455° C.

22. The method of claim 15, wherein said motive fluid does not significantly vaporize when intermixed with said slurry.

23. The method of claim 15, wherein said chamber zone is provided with a flow stabilizing zone for minimizing turbulence in the fluid flowing therethrough.

24. The method of claim 23, wherein the Reynolds number of the fluid flowing through said chamber zone is less than 2000 and is less than the Reynolds number of the fluid flowing through conduits coupled to said chamber zone.

25. The method of claim 15, wherein said hot, erosive slurry is at a temperature in the range of 250°-700° F.

26. The method of claim 15, wherein pressure is exerted on said motive fluid in a pumping zone.

27. The method of claim 26, wherein motive fluid is continuously supplied at said pumping zone.

28. The method of claim 26, wherein said motive fluid is cooled between said pumping zone and said chamber zone.

29. The method of claim 28, wherein said motive fluid is cooled by an indirect heat exchanger.

30. The method of claim 15, wherein said motive fluid is cooled upstream of said chamber zone.

31. The method of claim 30, wherein said motive fluid is cooled by an indirect heat exchanger.

32. The apparatus of claim 1 wherein said chamber encloses a volume at least as great as the maximum displacement of said pumping means.

33. The apparatus of claim 32 wherein said chamber volume is 2 to 10 times greater than said pump maximum displacement.

34. The method of claim 15 wherein said pump displaces a volume of said motive fluid substantially less than the volume of said chamber zone.

* * * * *